US005797333A

United States Patent [19]

Hensley

[11] Patent Number: 5,797,333

[45] Date of Patent: Aug. 25, 1998

[54] FUEL PELLET FINES COLLECTION SYSTEM

[76] Inventor: Carroll G. Hensley, 3769 Highway 11 E., Limestone, Tenn. 37681

[21] Appl. No.: 814,712

[22] Filed: Mar. 11, 1997

[51] Int. Cl.[6] ..... F23B 7/00

[52] U.S. Cl. ..... 110/233; 110/257; 110/110; 110/166; 126/68; 126/73

[58] Field of Search ..... 110/110, 233, 110/220, 255, 257, 166; 126/41 D, 58, 65, 66, 68, 73

[56] References Cited

U.S. PATENT DOCUMENTS

| | | | |
|---|---|---|---|
| 4,517,903 | 5/1985 | Richmond et al. | 110/233 |
| 5,123,360 | 6/1992 | Burke et al. | 110/233 |
| 5,243,963 | 9/1993 | Riener | 110/110 X |
| 5,343,819 | 9/1994 | Charest | 110/233 |

FOREIGN PATENT DOCUMENTS

| | | | |
|---|---|---|---|
| 1257-359 | 9/1986 | U.S.S.R. | 110/233 |

*Primary Examiner*—Henry A. Bennett
*Assistant Examiner*—Susanne C. Tinker

[57] ABSTRACT

An improved augering device and an accessible ash and pellet fines collection drawer which function together as a unique combination to remove pellet fines from a wood pellet burning stove, wherein the augering device has a screw mounted in a barrel formed by a tubular wall which also provides the pellet outlet to the firebox. Sieving apertures are formed through the tubular wall and are of a size particularly suited for the sieving of fines from the pellet fuel. The ash and fines collection drawer is adapted for positioning below the apertures in a non-fired portion of the stove, and an access opening is provided through a wall portion of the stove for insertion and removal of the drawer with respect to the stove.

15 Claims, 3 Drawing Sheets

FUEL PELLET FINES COLLECTION SYSTEM

FIELD OF THE INVENTION

This invention concerns a collection or purging system for removing wood pellet fuel dust, i.e., wood fines from the pellet feed stream. These fines are generated by breaking of the frangible pellets during transport of the pellets through various stages on their way to the combustion chamber of the stove. In particular the invention features a unique fines sieving device which is used in conjunction with an auger feed mechanism enclosed within a portion of a pellet burning stove, and which transfers frangible wood pellets from a hopper to the firebox of the stove.

BACKGROUND OF THE INVENTION

Pellet burning stoves which use an auger mechanism for the transfer of pellet fuel to the firebox or ignition chamber such as those disclosed by U.S. Pat. Nos. 4,787,322; 4,945,837; 4,947,769; 5,137,010; 5,295,474; 5,383,446; and 5,488,943, the disclosures of which are hereby incorporated herein by reference in their entirety, have a drawback which ultimately affects the safety and efficiency of these stoves. The pelletized fuel is made from sawdust or ground up agricultural or other waste products which are extruded and compressed into the pelletized fuel, e.g., rods of 7/32 inch diameter and ½ inch length, which have a relatively low degree of structural integrity. Consequently, as these pellets are jostled about they break down into fines, i.e., dust and small particles, particularly at their ends. The augering process used to convey the fuel only exacerbates this problem by rubbing the pellets together. These fines when deposited into the ignition chamber, form carbonized agglomerations which do not readily pass through the combustion grates typically employed in most pellet burning stoves. A build up of these agglomerations diminishes air flow through the combustion grate and reduces the combustion efficiency of the stove. Further, such combustion efficiency reduction can result in incomplete burning of the pellet fuel and the creation of soot which could pose a safety problem if the stove is not fitted with special venting structure.

OBJECTS OF THE INVENTION

Objects, therefore of the present invention are: (1) to provide an apparatus for the removal of fines already present in the pelletized fuel material or created by the augering of the fuel material in the fuel conveyance system; and (2) to provide such apparatus by means of an inexpensive modification of the stoves disclosed in the aforesaid patents.

SUMMARY OF THE INVENTION

The above and other objects hereinafter becoming evident have been attained in accordance with the present invention through the discovery of an improved pellet conveyance system which employs an augering device and which further employs an accessible fines collection drawer or pan means, which device and drawer means function together as a unique combination to remove pellet fines from the conveyance system of a pellet burning stove, and, in its broad embodiment said combination comprises an augering device having a screw means mounted in a tubular barrel means having an ascending section provided with a pellet inlet at its lower end and a pellet outlet at its upper end, said upper end having a descending section providing said outlet opening into a combustion chamber or firebox of said stove, said barrel means being formed by wall means having sieving aperture means therethrough of a size particularly suited for the sieving of fines from the pellet fuel material, drawer means adapted for positioning below said aperture means in a non-fired portion of said stove for collecting said fines, and access opening means through a wall portion of said stove means for insertion and removal of said drawer means into and from said stove.

The invention will be further understood from the following drawings of certain preferred embodiments and the description thereof wherein.

Figure 1:
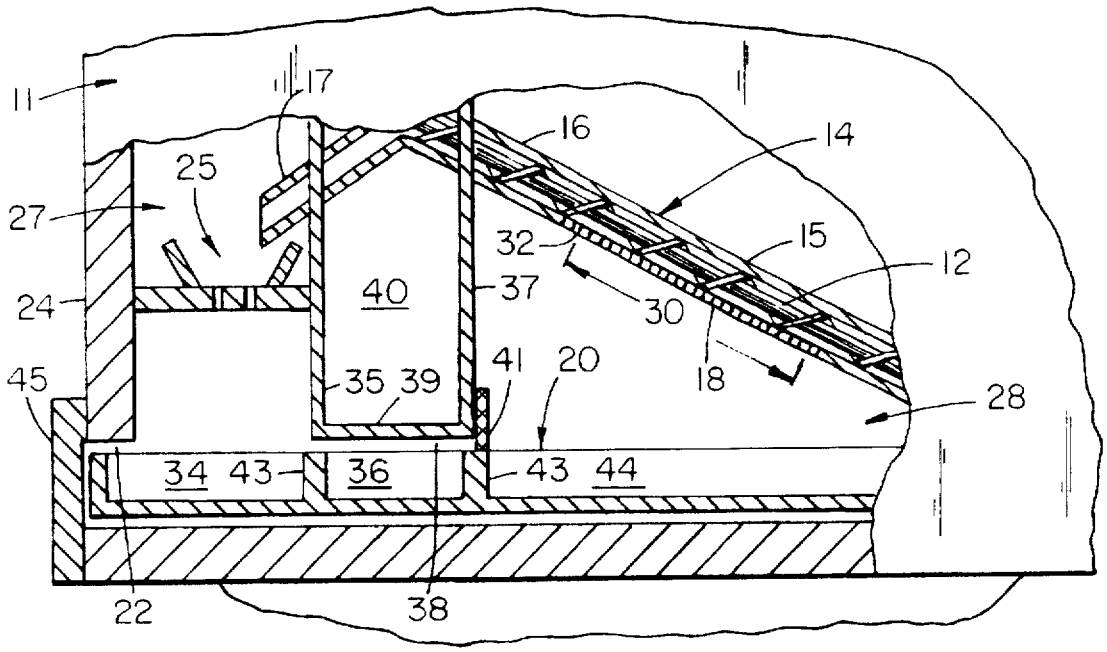
FIG. 1 is a side elevational view of a pellet stove with a cut-away section showing the present sieving device which includes an auger mechanism having a conveyance barrel means with a multiplicity of small holes in the ascending section of the barrel means as the sieving structure, and a collection drawer, or pan means.
Figure 4:
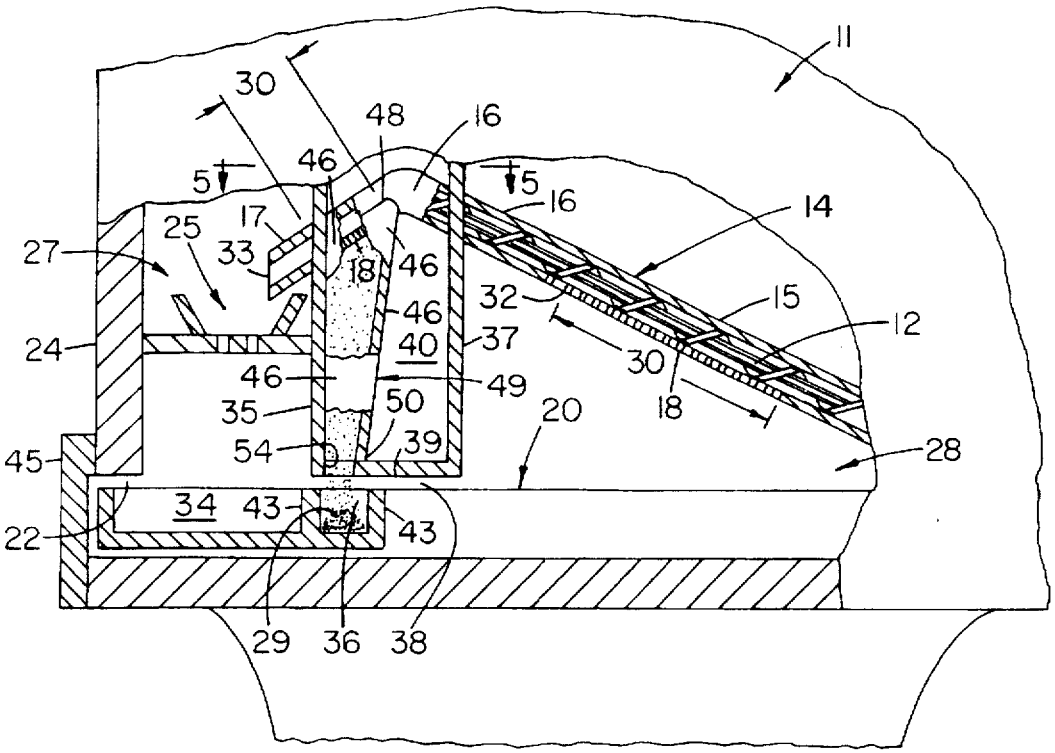
Figure 5:
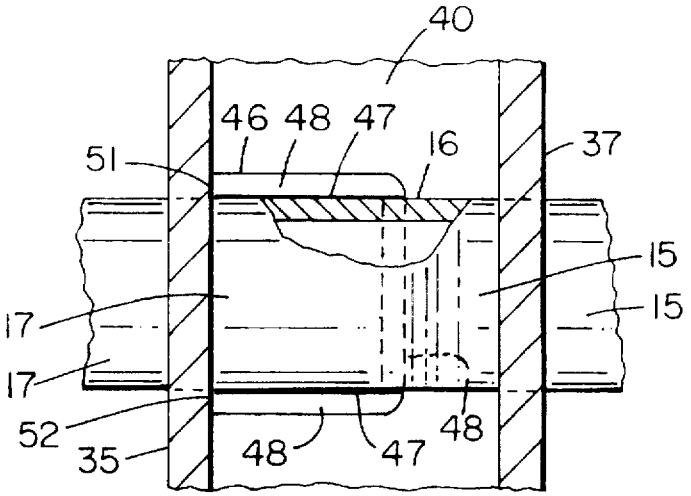
Figure 6:
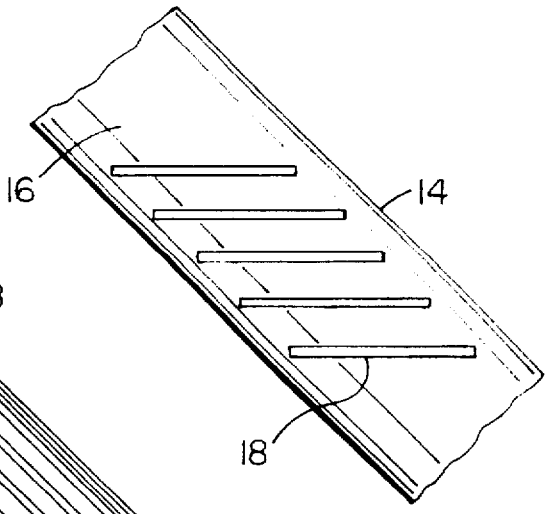
Figure 7:
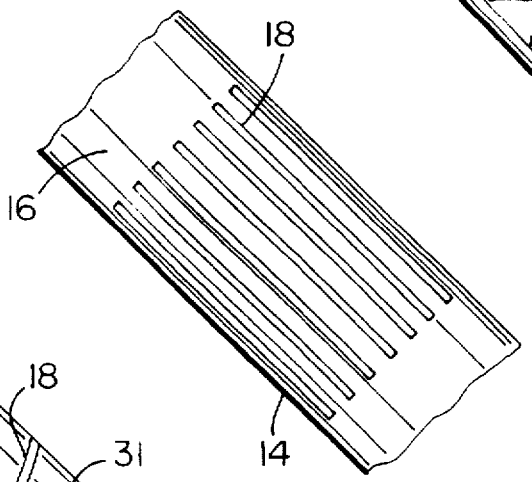
Figure 8:
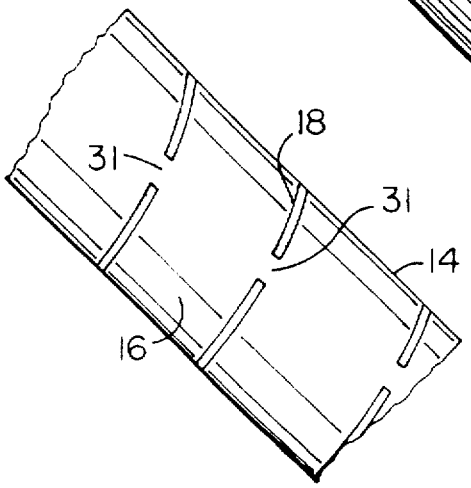

FIG. 4 is a view as in FIG. 1 showing the sieving structure primarily in the descending section of the barrel means and having a fines directing chute or down-conduit means positioned in the combustion air chamber or plenum of the stove, e.g., such as chamber 54 shown in the aforesaid U.S. Pat. No. 5,137,010, and adapted to direct the fines from the plenum into said drawer means;

FIG. 5 is an enlarged cross-sectional view taken along line 5—5 of FIG. 4 in the direction of the arrows; and FIGS. 6–8 show variations of the aperture means through the auger barrel wall.

DETAILED DESCRIPTION OF DRAWINGS

Referring to the drawings and with particular reference to the claims hereof, the present fuel pellet sieving device is readily adapted for modifying a wood pellet burning stove 11 having a pellet feed mechanism consisting of an auger screw means 12 mounted for rotation in and surrounded by an auger barrel means 14 formed by a substantially round tubular wall 16 having an ascending section 15 provided with a pellet inlet end 23, and having a descending section 17 providing a pellet outlet end 33. In accordance with the embodiment of the present invention of FIGS. 1–3, the barrel wall 16 is provided with sieve aperture means 18 in ascending section 15 for allowing only the passage of pellet fines from said barrel, said aperture means being positioned above a fines collection drawer means 20, said drawer means being accessible by way of an access opening means 22 formed through the front wall portion 24 of said stove whereby said drawer means may be withdrawn and emptied of ash and of fines 29.

In the embodiment of FIGS. 4 and 5, the sieve aperture means 18 are provided in the descending section 17 located within plenum 40. With this arrangement, a bristle brush or the like can be pushed up into section 17 to periodically clean the sieve means of fines which may become stuck in the apertures. Chute means or down-conduit means 49 comprised of a chute-like wall 46 is preferably provided in plenum 40 and having its upper end 48 substantially sealed to section 17 as by welding at 47 and surrounding operture means 18. The lower end 50 of wall 46 is preferably substantially sealed, as by welding, to floor or wall 39 of the plenum 40 and surrounds a fines outlet port 54 through wall 39. The substantially vertical side edges 51 and 52 of wall 46 are likewise substantially sealed against plenum wall 35 such that the emission of fines into the firebox is minimized.

Figure 2:
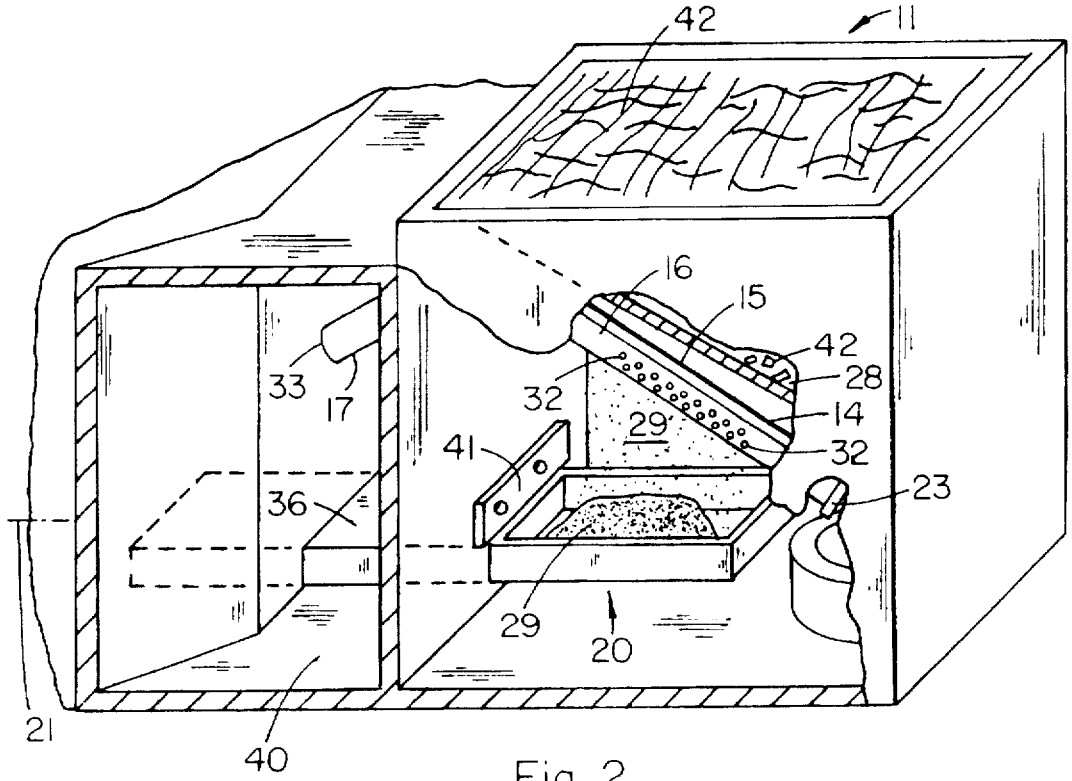
FIG. 2 is a perspective cut-away view of a pellet stove as in FIG. 1 showing pertinent structures and demonstrating how pellet fines exit the sieve device and collect in a fines collection compartment of one embodiment of the drawer means.
Figure 3:
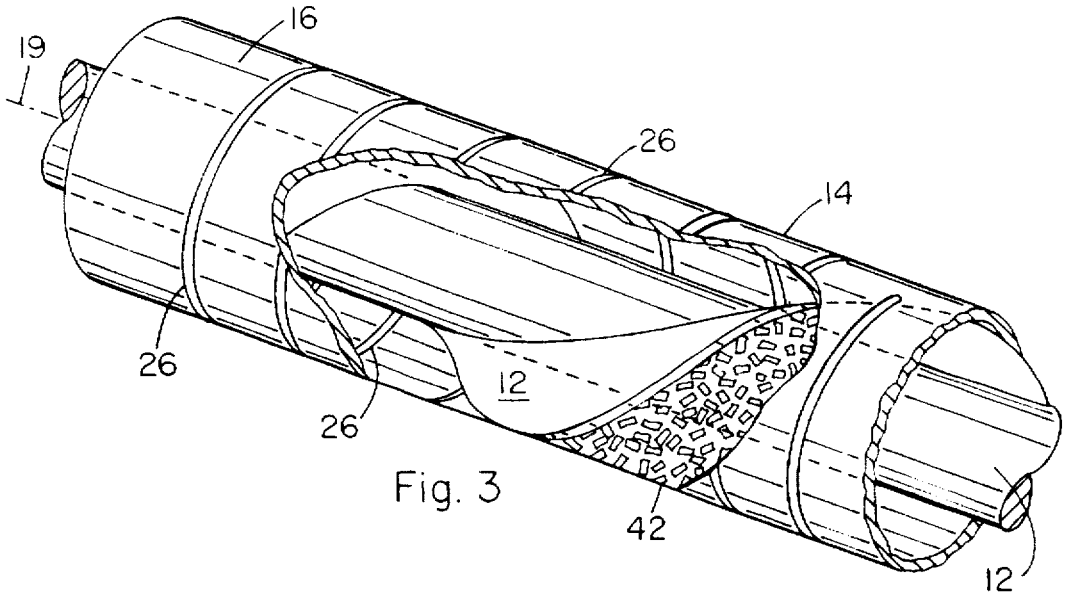
FIG. 3 is a cut-away view of a spiral slot embodiment of the sieving aperture means through the auger barrel wall.

In this embodiment, the drawer means 20 is shortened and the fines collection compartment 36 is primarily positioned directly underneath outlet port 54 and thus can be formed considerably smaller in width and length than in the embodiment of FIGS. 1–3. This embodiment of FIGS. 4 and 5 is quite important since some stoves cannot provide adequate interior space behind the plenum chamber 40 such as to accommodate the sieve means and fines collection pan.

Preferred embodiments of such stoves 11 for use with the present invention are shown in U.S. Pat. Nos. 5,295,474 and 5,137,010 which show an inclined auger barrel pellet feed system. A useful pellet feed screw 12 is generally of the type shown as 66 in FIG. 1 in U.S. Pat. No. 4,787,322, but without paddles 26 and with its flights being unidirectional, and being mounted for rotation in and surrounded by a tubular walled auger barrel.

The present fuel sieving device is constructed by choice such as to substantially prevent pellet fines from ascending auger barrel 14, or from passing out of descending section 17 along with pellets into the ignition chamber or firebox 27. The fines are screened out by way of small dimensioned aperture means generally designated 18 and of any configuration. Falling from said aperture means, the pellet fines settle in collection drawer means 20, as is best shown in FIGS. 2 and 4.

The present auger barrel 14 consists of a cylindrical hollow tube having a rounded tubular wall 16 made preferably of steel and a thickness of, e.g., between about 1/16 to about 1/8 of an inch. In the embodiment of FIG. 3, a portion or segment 30 of the auger barrel 14 is provided with aperture means 18 in the form of spirally oriented slot means 26 cut through the tubular wall. As the pellets are conveyed through the barrel by way of the auger screw, the pellets travel over the slot means and the fines pass therethrough into the drawer means.

Slot means 26 preferably has a width of between, e.g., about 1/32 to 1/8 of an inch and are provided with chamfered or rounded inside edges so as to preclude any additional cleavage of the pellets as they slide over the slot means. The slot means also may be disposed around said barrel in different configurations for example, and as shown in FIGS. 6 and 7 respectively, the slot means may be oriented angularly or longitudinally with respect to the barrel axis 19 and extend any desired distance around the barrel.

One such configuration provides for the thickness of the barrel wall to be sufficient for continuous spiraling of the slot means along a substantial portion or segment 30 of the barrel without significantly weakening the structural integrity of the barrel. Another such configuration of this spiral embodiment as shown in FIG. 8 provides lands 31 which span the spiral slot means at intervals, e.g., after approximately each complete rotation about the barrel, and thus provides substantial structural support to a thinner walled barrel.

A further embodiment of the sieve means is shown in FIGS. 1, 2, and 4 wherein the aperture means 18 consists of small diameter holes 32 of, e.g., from between about 1/32 to about 1/8 of an inch in diameter, which are disposed in any pattern or randomly around a significant section, such as 30, of barrel 14, or provided in, e.g., the lower diametrical half of section 17 and function to screen out fines therefrom. Again, the inside rims of these holes are preferably rounded or chamfered to minimize abrasion of the pellets as they are augured through the barrel.

It is noted that with reference to the claims hereof which specify the size of the aperture means thru the auger barrel wall, whether they be round holes or slots, the tenn "diameter" is used to define the size and refers both to the actual diameter of round holes and to the distance across each slot or any other shaped aperture thru which the fines arc sifted.

The collection drawer means 20 of the present device is a modification of the ash pan as shown in FIGS. 1 of U.S. Pat. No. 5,295,474. The present collection drawer, as is shown in FIGS. 1 and 2 is provided, preferably, with three distinct compartments spaced generally along its longitudinal axis 21. The ash collection compartment 34, as with the aforementioned prior ash pan, is positioned below the grate assembly 25 of the stove for the collection of ash and clinkers.

The insulating center compartment 36 of the drawer means extends further into the stove and resides in an insulating area generally designated 38 between the firebox 27 and hopper or storage section 28 of stove. The area 38 is provided by walls 35,37,39 which are disposed adjacent said center compartment and separate the drawer means from the plenum space 40. The insulation of this center compartment minimizes the transferal of any substantial portion of the heat generated within the firebox from reaching the hopper and other rearward sections of the stove and thus eliminates any the real possibility of inopportune ignition of pellets 42 within the hopper 28 or the auguring system.

Tight tolerances between the center compartment walls and the walls of plenum 40 ensure a minimal amount of air leakage between the firebox and pellet storage area. In a further embodiment, a flexible fire resistant gasket or thermal barrier means 41 is provided within the insulating area and is affixed to wall 37 and extends to adjacent or touches in a brushing manner one of the divider walls 43 which extend generally laterally across the drawer means. This gasket effectively prevents any air movement between the firebox and the pellet storage area of the stove.

The final compartment 44 is for fines collection, and is placed within the rearward or hopper section of the stove and positioned directly below aperture means 18 to thereby receive and collect any pellet fines which fall therethrough.

Removal of the drawer with its associated compartments is accomplished through an access opening means 22 through the front wall portion 24 of the stove as is shown in FIGS. 1 and 4. A removable facade cover 45 which may be held on the stove front with permanent type magnets, typically covers the access opening until removal of the drawer means is required.

The invention has been described in detail with particular reference to preferred embodiments thereof, but it will be understood that variations and modifications will be effected within the spirit and scope of the invention.

I claim:

1. A combination of a pellet feed system having a fuel pellet augering device and an accessible fines collection drawer means which function together to remove pellet fines from the pellet feed system of a pellet burning stove, said augering device having a screw means rotatably mounted in a tubular barrel means for augering pellets from a hopper means of the stove to a firebox thereof, said barrel means being formed by tubular wall means having an ascending section and a descending section, sieving aperture means through at least one of said sections, said aperture means being of a size suited for the sieving of fines from the pellet fuel material, said collection drawer means being positionable below said aperture means in a non-fired area of said stove, and access opening means through a wall portion of said stove for allowing removal and replacement of said drawer means with respect to said stove.

2. The combination of claim 1 wherein said aperture means through said tubular wall means extends throughout a segment thereof and is of a structural form selected from the group consisting of (a) a plurality of small holes through at least the lower diametrical portion of said tubular wall means, (b) at least one continuous spiral slot through said wall means, (c) at least one non-continuous spiral slot through said wall means, (d) a series of circumferentially spaced slots through said wall means and oriented axially thereof, or (e) a series of longitudinally spaced slots through said wall means and oriented angularly with respect to the barrel means axis.

3. The combination of claim 2 wherein each of said aperture means has a diameter of from about 1/32 to about 1/8 inch.

4. The combination of claim 1 wherein said aperture means comprises a plurality of small holes in a segment of said tubular wall means through at least the lower diametrical portion thereof.

5. The combination of claim 1 wherein said drawer means comprises rectangular floor means and peripheral wall means extending upwardly therefrom adjacent the edges thereof, and divider wall means extending upwardly from said floor means and extending laterally thereacross to said peripheral wall means, whereby said drawer means is divided into an ash collection first compartment and a fines collection second compartment.

6. The combination of claim 5 wherein said divider wall means comprises longitudinally spaced divider walls providing a thermal insulator third compartment between said first and second compartments.

7. The combination of claim 6 wherein a thermal barrier means is provided on said stove and touches in a brushing manner a divider wall.

8. The combination of claim 1 wherein said sieve means is formed through a segment of said descending section of said tubular wall means.

9. The combination of claim 8 wherein said segment is located within a forced-air-fed plenum of said stove, said plenum having floor means spaced below said segment, a fines outlet port means formed through said floor means, and down-conduit means extending between said segment and said port means for conveying fines to said port means.

10. The combination of claim 9 wherein said down-conduit means comprises wall means having an upper end portion surrounding and sealed around said segment, and having a lower end portion surrounding and sealed around said port means.

11. A sieving combination for removing fuel pellet fines from the pellet feed mechanism of a wood pellet burning stove, wherein said mechanism consists of an auger shaft means adapted for connection to an electric drive motor for being rotated thereby, said shaft means being mounted in and surrounded by an auger barrel formed by a round tubular wall means which is structurally independent from and isolated from any fired portion of said stove, said wall means being provided with a sieve means comprising aperture means for allowing only the passage of pellet fines from said barrel and into a fines collection means, said aperture means being of a structural form selected from the group consisting of (a) a plurality of small holes through at least the lower diametrical portion of said wall means, (b) at least one continuous spiral slot through said wall means, (c) at least one non-continuous spiral slot through said wall means, (d) a series of circumferentially spaced slots through said wall means and oriented axially thereof, or (e) a series of longitudinally spaced slots through said wall means and oriented angularly with respect to the barrel means axis.

12. The combination of claim 11 wherein said aperture means comprises a plurality of small holes in said barrel means wall means through at least the lower diametrical portion thereof.

13. The combination of claim 11 wherein said sieve means comprises a series of slots formed through said barrel wall means, said slots having a width smaller than that of said fuel pellets.

14. The combination of claim 13 wherein said slots are arranged to provide a spiraling series of slots.

15. The combination of claim 7 wherein each said aperture means has a diameter of from about 1/32 to about 1/8 inch.

* * * * *